United States Patent [19]

Nelson

[11] 4,185,785

[45] Jan. 29, 1980

[54] GRINDING MILL DIAPHRAGM DISCHARGE SYSTEM

[75] Inventor: John E. Nelson, Montreal, Canada

[73] Assignee: Dominion Engineering Works Limited, Lachine, Canada

[21] Appl. No.: 927,027

[22] Filed: Jul. 24, 1978

Related U.S. Application Data

[63] Continuation of Ser. No. 802,353, Jun. 2, 1977, abandoned.

[51] Int. Cl.[2] ..... B02C 17/22

[52] U.S. Cl. ..... 241/70; 241/171

[58] Field of Search ..... 241/70, 79, 79.2, 79.3, 241/153, 171, 181, 284

[56] References Cited

U.S. PATENT DOCUMENTS

| | | | |
|---|---|---|---|
| 1,770,977 | 7/1930 | Fowden | 241/70 |
| 2,405,633 | 8/1946 | Barker | 241/171 X |
| 2,948,481 | 8/1960 | Daman | 241/171 X |
| 3,231,203 | 1/1966 | Hardinge et al. | 241/70 X |
| 3,294,325 | 12/1966 | Nelson | 241/70 |
| 3,599,882 | 8/1971 | Sabaski et al. | 241/70 |

*Primary Examiner*—Howard N. Goldberg
*Attorney, Agent, or Firm*—Raymond A. Eckersley

[57] ABSTRACT

This invention is directed to an improved rotary grinding mill such as a ball mill, rod mill or an autogenous mill, having an improved arrangement wherein the usual "overflow" or "grate discharge" arrangements are dispensed with in favor of an annular array of lifter segments providing a diaphragm having a radial clearance from the mill shell, being spaced from the inner surface of the mill head to provide an annular entry slot of restricted opening, with a plurality of lifter blades located therein. The improved mill permits the maintenance of favorable flow gradients within the mill while allowing the carrying of a maximum usable quantity of grinding media, despite increases in mill size that militate against the combination. The discharger provides a sufficient intake area that large throughputs may be accommodated, while avoiding many of the drawbacks associated with grates.

3 Claims, 4 Drawing Figures

GRINDING MILL DIAPHRAGM DISCHARGE SYSTEM

This is a continuation application of Application Ser. No. 802,353, filed June 2, 1977, now abandoned.

This invention is directed to material reduction rotary grinding mills of the ball, rod or autogenous type, and in particular to an improved discharge arrangement for such mills.

The present day trend to increase in grinding mill sizes particularly mill length has accentuated the problems encountered in providing adequate mill throughput together with optimum grinding media carrying capacity.

Two approaches to the problem of mill discharge as presently practiced comprise:

(1) the provision of grates at the discharge head, permitting passage of pulp to the head lifter zone, for readily inward displacement to the discharge orifice.

(2) the provision of a high level discharge through the mill orifice by fluid gradient referred to as an overflow mill.

The first mill type resuts in a so-called low level discharge mill, wherein the pulp exit level is maintained at a fairly low level in the mill drum. Unfortunately, the grates used are subject to becoming blocked, when plugging takes place. In the case of ball, pebble and autogenous mills the media which comprise a portion of the charge of the mill and serve to impact and grind down the rest of the charge, also wear down until they approach the size of the grate apertures, and can then be come wedged therein to cause plugging, increases in mill length, relative to diameter with corresponding need for increased grate throughput per unit area of grate lead more rapidly to plugging of the grates, with associated discharge problems.

Overflow mills are even more adversely affected by changes in mill size or porportion. In order to achieve a particular throughput or overflow it is necessary to provide a commensurate hydraulic gradient across the mill from the inlet to the outlet. An increase in mill length diminishes the gradient between inlet and outlet, unless the level at the inlet can be correspondingly raised or the level at the outlet can be correspondingly lowered. Such is not readily accomplished with existing arrangements without, at the same time, reducing grinding media carrying capacity.

The present invention provides, in a grinding mill having a reduction compartment bounded by heads at the ends thereof an improved mill discharge means intermediate the ends having an annular discharge zone from a reduction compartment of the mill with a substantially unobstructed slot intake located at a radius intermediate the interior radius of the discharge trunnion of the mill and the interior radius of the mill drum, and lifter means to discharge material therethrough.

The invention further provides an annular intake slot having an entry thereto facing outwardly towards the inner surface of the mill drum. The annular discharge means utilizes an annular diaphragm the radially outer edge thereof being spaced a selected distance from an axially adjacent surface to provide a predetermined slot width.

The adoption of the annular diaphragm and intake slot provides a certain latitude in design size, in that the total slot area is a function of diaphragm outer radius and of the slot width. Slot width is controlled by the spacing of the diaphragm edge from the adjoining head face. This slot is normally of a width larger than the diameter of the largest of the balls or pebbles used in the mill. A ball trap may be readily provided at the discharge orifice, to return any escaping balls or pebbles to the mill drum as is well known in the art.

Owing to the inherent self-shrouding nature of the slot, in its downward facing orientation at the bottom of the mill, it is unlikely that balls will enter the slot to any significant extent.

Applying the theory of the present invention to existing overflow mills of the largest sizes in one specific mill it appears that the adoption of an annular diaphragm providing a moderate slot width, provides a capacity of discharge sufficient to cause a drop in pulp level at the outlet and thus achieve a suitable gradient through the mill without any diminution in ball load. Such beneficial gradients had not been present using the prior overflow discharge arrangements. Further, the selected dimensions to achieve this outstanding result are conservative, and the adoption of a greater slot width, in combination with a diaphragm of greater radius so as to obtain a greater slot length would lead to discharge rates considerably in excess of those calculated while exceeding the required gradient in the mill.

It will be understood that the functions governing effective slot area, namely the radius of the diaphragm which thereby controls the (peripheral) length of the slot and the axial spacing of the diaphragm from the head or other adjacent surface which governs the width of the slot, are independent functions, the mathematical product of which gives the slot area.

Thus it can be seen that adoption of the present invention makes available a discharge arrangement of great flexibility, which may be further enhanced by particulars of design.

In certain instances it may be desired to provide a mill having a certain coarse classifying action in the transfer zone, which can be readily achieved using a diaphragm in which the lifter blades do not extend outwardly to the outer edge of the diaphragm. There is then obtained a coarse classifying effect as pulp rises vertically through the zone under the influence of the static head with finer particles rising more readily to be entrained by the lifters for discharge from the mill.

When compared with the conventional grate discharge arrangement, the discharge diaphragm according to the present invention also is lower in prime cost and both easier and less costly to maintain. It can be appreciated that whereas the elements of a grate tend to produce jamming of larger particles in the grate slots, the continuous and unobstructed form of the annular opening provides an aperture inherently substantially immune to plugging.

An annular diaphragm according to the present invention particularly lends itself to production as a plurality of unitary cast segments, each segment comprising a segment of an arc of an annulus of predetermined inner and outer radial extent, suitable for use as a lifter within a rotary grinding mill having a drum of predetermined inner diameter, with opposed end heads attached thereto, one head having a discharge orifice extending axially outwardly therefrom, the lifter member having a backing plate portion with a radially inner edge and a radially outer edge, the plate comprising a predetermined portion of the diaphragm, at least one rib means having one edge secured to the backing plate, the rib means extending substantially normally from the surface of the backing plate having a free edge opposite the one edge profiled along a portion of the length thereof for substantially sealing engagement with an inner surface of the head, the radial dimension of the backing plate between its inner and outer edge, in relation to the internal radius of the mill discharge orifice and to the radius of the inner surface of the drum being such as to permit the backing plate to overlie a portion of the interior of the orifice and to extend to a predetermined distance from the drum inner surface, the rib means spacing the plate axially from the head inner surface, to provide, in use in cooperation with other ones of the segments and the head inner surface an entry slot of a predetermined size.

Certain embodiments of the invention are described, reference being made to the accompanying drawings, wherein.

Figure 1:
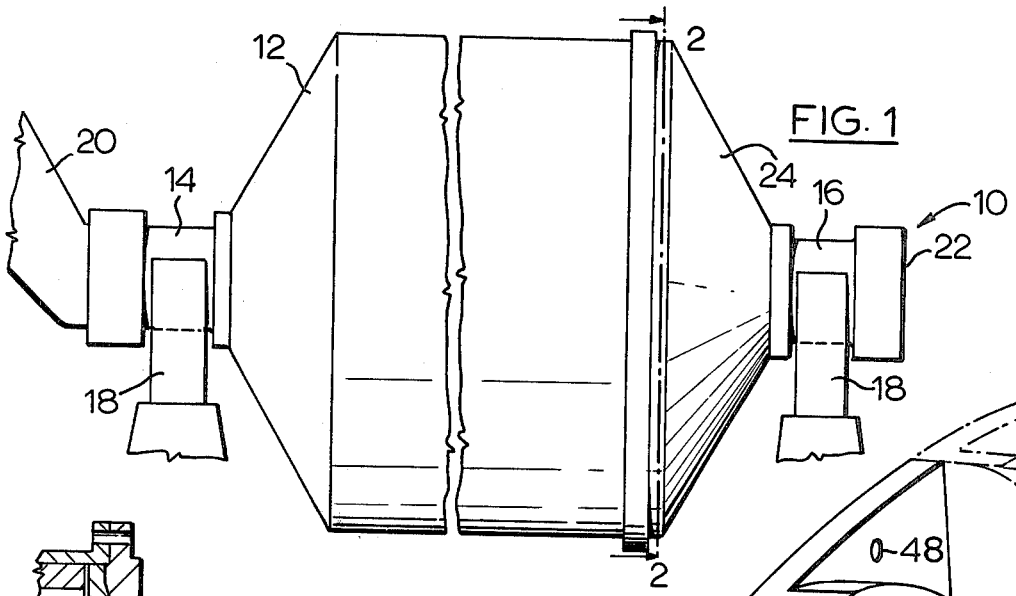
FIG. 1 shows a side view of a mill of the type suitable for incorporating therein a discharge arrangement in accordance with the present invention.

FIG. 1 shows a mill 10 having a drum 12 rotatably supported by trunnions 14, 16 in bearings 18. It will be understood that other types of mill having different bearing arrangements may also readily utilise the present invention. The illustration of the drum 12 is broken to indicate the extensive length thereof, relative to the drum diameter.

The mill 10 has a charge hopper 20 and a discharge trunnion 22. A head 24 at the discharge end of the mill, (see also FIG. 2) has an annular lifter diaphgram 26 spaced by lifter blade 28 from the inner face 30 of the head 24. This inner face 30 is shown to comprise a liner 32 bolted to the head.

A further annular liner 34 can be combined with the diaphragm 26 to provide an entry throat of width "t" facing generally outwardly towards the drum wall. By selecting the dimensions and position of the liner 34 the orientation of the slot or entry may be selectively controlled.

The diaphragm 26 may well be of one-piece construction, or built up of component parts. Adoption of a plurality of unitary segments 40 or 42 (FIGS. 3 and 4) offers a number of advantages and comprises a very suitable solution. Bolt holes 48 permit the segments 40, 42 to be secured to the head 24, being located in spaced relation to the lifting surface with sufficient clearance so as to minimise the likelihood of pulp blockage by bolts extending across the pulp flow path.

Figure 2:
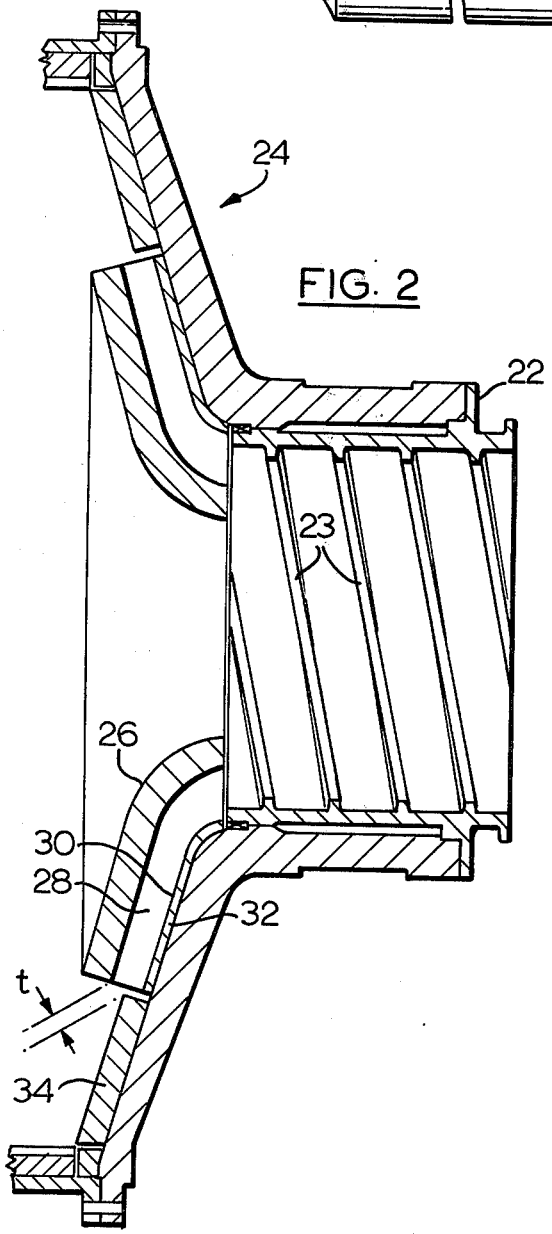
FIG. 2 is a vertical diametrical part section extending from the line 2—2 of FIG. 1 and through the discharge trunnion.
Figure 3:
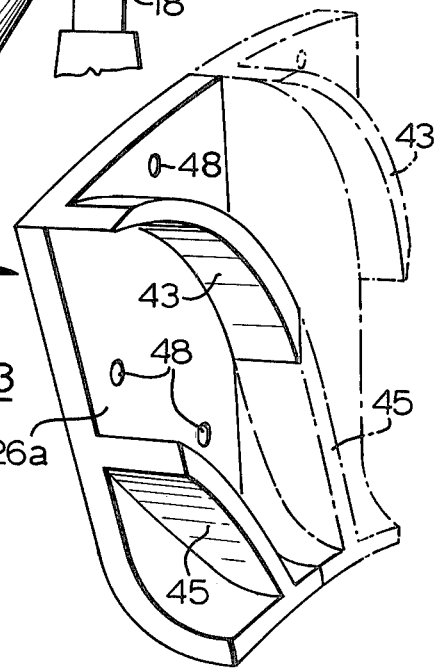
FIG. 3 is a general view of two adjoining lifter segments according to a first embodiment of the present invention.
Figure 4:
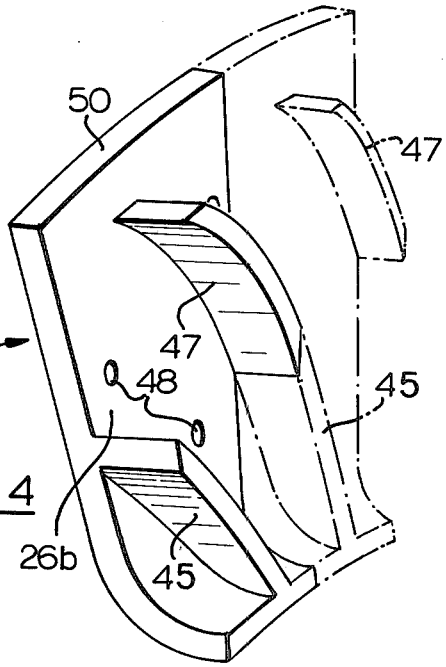
FIG. 4 is a like view of a second lifter segment embodiment.

The segments 40 of FIG. 3, (one being shown in phantom) are each provided with a diaphragm plate portion 26*a* and two portions of lifter blade 43, 45, which cooperate to provide lifter blades extending the full radial extent of the diaphragm back plate segment 26, as shown in FIG. 2. In the FIG. 4 embodiment the lifter blade portions 47, 49, 45 do not extend to the radial outer rim 50 of the diaphragm segment 26b, but terminate at a smaller radius. This provides an annular classifier zone lying on the outlet side of the diaphragm 26, through which pulp of suitable consistency can rise, to be entrained by the lifter blades 47, 49, 45, while larger particles and any balls or pebbles that might enter the zone are not picked up by the lifter blades 47.

With reference to the FIG. 2 embodiment, it will be appreciated that the presence of a wear plate 34 or liner may well prove unnecessary, in view of the protection afforded by the overhang of the diaphragm 26. The segments 40, 42 which generally comprise the diaphragm 26 may well be cast in chromemolydenum or ni-hard (TM) material, while the use of rubber covering for the lifter blades is contemplated.

Referring again to FIG. 2, the discharge trunnion 22 is illustrated as having a ball return spiral 23, well known in the art, by means of which any balls or pebbles that pass through the annular slot and are discharged to the trunnion by the lifters, can be passed back into the drum in a direction opposite to pulp discharge through inclined ball tubes (not shown) extending axially through the diaphragm.

It will be understood that the present invention is equally applicable to mills of the type supported by wrap-around bearings which directly support the drum. In such cases, the trunnion is used only to serve the purposes of mill discharge.

Diaphragm segments in accordance with the present invention are particularly suited to be sized for ready handling into the mill through one or either of the mill trunnions, whereby maintenance by replacement can be more readily carried out.

What I claim as new and desire to secure by Letters Patent of the United States is:

1. A rotary grinding mill having a drum, opposed end heads on said drum, one head having a central pulp discharge orifice, a diaphragm spaced axially from said one head to provide a pulp containment end zone open at its radially outer edge for the ingress of pulp from the drum, the diaphragm having a plurality of lifter ribs dividing the end zone into a plurality of adjacent zone segments, the radially outer portion of the pulp containment zone defining a pulp classifier wherein pulp is differentially separated in accordance with the relative fineness thereof, the radially outer edge of the diaphragm overhanging the opening to said pulp zone, to deflect larger particles away from the pulp zone, said lifter ribs extending into the pulp containment zone to provide selective transfer of pulp therefrom.

2. The grinding mill according to claim 1, said diaphragm comprising a plurality of segmented plate portions.

3. The grinding mill according to claim 2 wherein adjacent ones of said plate portions include portions of said ribs, positioned in mutual cooperating relation.

* * * * *